US010760355B2

(12) United States Patent
Farley

(10) Patent No.: US 10,760,355 B2
(45) Date of Patent: Sep. 1, 2020

(54) FLOAT SHOE HAVING CONCRETE FILLED, ECCENTRIC NOSE WITH JETS

(71) Applicant: Weatherford Technology Holdings, LLC, Houston, TX (US)

(72) Inventor: Douglas Brian Farley, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/217,930

(22) Filed: Dec. 12, 2018

(65) Prior Publication Data

US 2020/0190917 A1 Jun. 18, 2020

(51) Int. Cl.

| | |
|---|---|
| ***E21B 17/14*** | (2006.01) |
| ***E21B 34/06*** | (2006.01) |
| ***E21B 33/14*** | (2006.01) |

(52) U.S. Cl.

CPC ..... *E21B 17/14* (2013.01); *E21B 34/06* (2013.01); *E21B 33/14* (2013.01)

(58) Field of Classification Search

None

See application file for complete search history.

(56) References Cited

U.S. PATENT DOCUMENTS

| | | | | |
|---|---|---|---|---|
| 2,075,293 | A | 3/1937 | Larkin | |
| 4,060,581 | A | 11/1977 | Darby et al. | |
| 5,265,680 | A | 11/1993 | Withers et al. | |
| 5,669,443 | A | 9/1997 | Budde et al. | |
| 5,680,902 | A | 10/1997 | Giroux et al. | |
| 6,062,326 | A | 5/2000 | Strong et al. | |
| 6,070,667 | A * | 6/2000 | Gano | E21B 7/061 166/313 |
| 6,845,820 | B1 | 1/2005 | Hebert et al. | |
| 7,325,609 | B2 | 2/2008 | Hebert et al. | |
| 8,657,036 | B2 | 2/2014 | Barron et al. | |
| 9,291,007 | B2 | 3/2016 | Darbe et al. | |
| 2007/0246224 | A1 | 10/2007 | Krauss et al. | |

FOREIGN PATENT DOCUMENTS

| | | |
|---|---|---|
| WO | 02/33212 A1 | 4/2002 |

OTHER PUBLICATIONS

Weatherford, "Float & Stage Equipment," Brochure, copyright 2005, 44-pgs.

Search and Examination Report in counterpart EP Appl. 19208327.7, dated May 19, 2020, 9-pgs.

* cited by examiner

*Primary Examiner* — Matthew R Buck
*Assistant Examiner* — Douglas S Wood
(74) *Attorney, Agent, or Firm* — Blank Rome, LLP

(57) ABSTRACT

A float shoe for a downhole tubular or casing includes a housing, a nose, a support, and a valve. The housing is attached to the casing, and the nose having a shell of a millable material (e.g., composite, aluminum, etc.) extends from the housing. A support of cement, fills an internal cavity of the nose's shell and support a valve in the housing. The shell for the nose defines a flow passage communicating with the valve and can have a conical or eccentric shape to facilitate passage of the float shoe in a borehole during run-in. The shell for the nose can also have a port or jet that communicate the flow passage out the side of the nose.

19 Claims, 6 Drawing Sheets

FLOAT SHOE HAVING CONCRETE FILLED, ECCENTRIC NOSE WITH JETS

BACKGROUND OF THE DISCLOSURE

During the construction of oil and gas wells, a borehole is drilled to depth, the drill string is removed, and casing is inserted. The annular space between the outside of the casing and the wall of the borehole is then conditioned for cementing by pumping conditioning fluid down the casing. The conditioning fluid flows radially outwardly from the bottom of the casing and passes upwardly through the annular space where it entrains debris and carries it to the surface. Finally, cement is pumped downwardly through the casing. The pumped cement squeezes radially outwardly from the bottom of the casing and passes upwardly into the annular space where the cement then sets.

Conventionally, a fill valve is disposed toward the downhole end of the casing. The fill valve prevents fluid from entering the casing from the borehole, but permits fluid (i.e., mud, conditioning fluid, cement, etc.) to flow from the casing into the borehole. The fill valve is normally incorporated in a float shoe or a float collar. The float shoe is fitted on the bottom of the casing, whereas the float collar is typically incorporated between two lengths of casing.

FIG. 1 illustrates a conventional float collar 10A of the prior art. The collar 10A includes a tubular housing 12 accommodating a fill valve 30 therein. The fill valve 30 has a valve member 36 that is generally mushroom shaped with a head biased upwardly against a valve seat 32 by a spring 38 circumjacent a stem of the valve member 36. A base 34 in the seat 32 supports the valve member 36 and the spring 38.

The interior 12 of the housing 12 has an annulus filled with high density cement 20 disposed therein. The cement 20 supports the fill valve 30 and has a passage 22 communicating with the fill valve 30. During use, mud, conditioning fluid, and cement can flow through the passage 22 and the fill valve 30, but fluid from the borehole is not permitted to pass uphole through the valve 30.

The float collar 10A is mounted with its box end 18 at the bottom of casing (not shown). The pin end 16 can attach to another extent of casing or tubular. Alternatively, a shoe 40 as in FIG. 2A with box thread 48 can thread to the pin end 16 of the collar 10A to form a float shoe. The shoe 40 includes cement 44 inside its end that defines a passage 46 for communicating with the float shoe.

During use as a float collar, the casing having the float collar 10A with the connected shoe 40 is run downhole in the wellbore. Once the casing is in position, mud is pumped down the casing. The mud flows through the fill valve 30 and then passes out the passage 46 in the shoe 40. The mud flowing from the bottom of the casing then travels upwardly through an annulus between the casing and the wellbore to carry debris to the surface. Typically, mud is passed through the fill valve 30 for several hours. Conditioning fluid (usually referred to as "spacer fluid") is then pumped down the casing. The conditioning fluid helps remove the mud and contains chemicals that will help the cement adhere to the casing.

After conditioning is complete, a charge of cement is pumped down the casing between a top plug and a bottom plug. After the bottom plug seats on (or near) the upper surface 24 of the float collar 10A, increasing pressure is applied against the top plug until a burst disk in the bottom plug ruptures and permits the cement to flow downwardly into the float collar 10A. The pressure applied to the cement by the top plug is transmitted to the head of the valve member 36, which moves downwardly away from valve seat 32, thereby permitting the cement to pass through the fill valve 30 and out the float shoe 40.

When the top plug contacts the bottom plug, no further cement passes through the fill valve 30. Pressure is then released on the top plug, and the fill valve 30 inhibits cement from flowing upwardly back inside the casing. After the cement has set, the top plug, bottom plug, fill valve 30, annular cement 20 in the float collar 10A, annular cement 44 in the shoe 40, and any other cement below the shoe 40 is drilled out.

As noted above, a shoe 40 as in FIG. 2A can be mounted to a float collar 10A to run in the casing in the borehole. The shoe 40 in FIG. 2A has a conventional nose 44 of cement defining a central passage 46 for communicating fluid (e.g., mud, conditioning fluid, and cement) out of the nose 40. The cement 44 is used because it can be readily drilled out after cementing operations.

In some wellbores, various features of ledges, carvings, and irregularities in the borehole can hinder the running of the casing to the planned depth. To overcome these obstacles, a float shoe nose with a conical or eccentric shape is commonly used. The shape and the material of the nose are preferably of sufficient strength to overcome high loads, yet are easily drilled using a drill bit. Composite and aluminum materials have been used in the past for these types of noses on the end of the casing.

For example, FIG. 2B illustrates a composite nose 50 of the prior art for use on a float shoe 10B. As before, the float shoe 10B includes a tubular housing 12 accommodating a fill valve 30 therein. The interior 12 of the housing 12 has an annulus filled with high density cement 20 disposed therein to support the fill valve 30. The cement 20 has a passage 22 in which the fill valve 30 is mounted.

The nose 50 is constructed of a composite material having wear resistant and drillable characteristics. Typically, fiberglass or some other composite material is used for the nose 50. Because the nose 50 is composed of composite material, it can be given a conical, eccentric shape. In this way, the nose 50 not only serves to direct fluid, but the eccentric conical shape of the nose 50 can aid in run-in of the assembly by facilitating the passage of the assembly through the borehole.

At an upper end, the nose 50 fits into the housing 12 of the float shoe 10B and is attached with a threaded connection 16, 56. A central bore 52 of the nose 50 is aligned with the longitudinal bore 22 of the annular cement 20 in the interior 14 of the housing 12. The nose 50 can also include a side port or jet 54 for the passage of fluid from the longitudinal bore 52 to the borehole (not shown).

As another example, FIG. 2C illustrates an aluminum nose 60 of the prior art for use on a float shoe 10C. As before, the float shoe 10C includes a tubular housing 12 accommodating a fill valve 30 therein (here, two fill valves are shown). The interior 12 of the housing 12 has an annulus filled high density cement 20 disposed therein to support the fill valves 30. The cement 20 has a passage 22 in which the fill valves 30 are mounted.

Because the nose 60 is composed of aluminum, it can be given a conical or eccentric shape and may have external features, such as wear resistant nodules, ribs, or the like. In this way, the aluminum nose 60 not only serves to direct fluid, but the shape of the nose 60 and any external features can aid in the run-in of the assembly by facilitating the passage of the assembly through the borehole.

At an upper end, the nose 60 fits into the housing 12 of the float shoe 10C and is attached thereto with a threaded connection 16, 66. A central bore 62 of the nose 50 is aligned with the longitudinal bore 22 of the annular cement 20 in the interior 14 of the housing 12. The nose 60 can also include a side port or jet 64 for the passage of fluid from the longitudinal bore 62 to the borehole (not shown).

Although the composite and aluminum noses 50, 60 on float shoes can be effective, the cost of these materials can increase the overall equipment cost. Side ports or jets for the noses 50, 60 are fabricated by drilling ports at an angle, which adds additional machine work and increases product cost. In addition to higher costs, aluminum materials of an aluminum nose 60 may be more difficult to drill up than composite materials of a composite nose 50. Yet, the composite materials often break up into larger pieces that can obstruct the drilling assembly.

The subject matter of the present disclosure is directed to overcoming, or at least reducing the effects of, one or more of the problems set forth above.

SUMMARY OF THE DISCLOSURE

According to the present disclosure, a float shoe for a downhole tubular, such as casing, comprises a housing, a nose, a support, and a valve. The housing comprises a first material and defines a bore therethrough from a first end of the housing to a second end of the housing. The first end is attached to the tubular. The nose comprises a second material, extends from the second end of the housing, and defines an internal cavity. The nose has a first passage communicating a distal outlet of the nose toward the bore of the housing. The support comprises cement, is disposed in the bore of the housing, and is disposed in the cavity of the nose. The valve is supported by the support in the bore of the housing. The valve is disposed in communication between the first end of the housing and the first passage of the nose.

The nose can define a port or jet communicating the first passage outside a side of the nose. The first material of the housing can comprise a metallic material, while the second material of the shell can comprise a composite material. The second material for the nose can be other millable or drillable materials, including aluminum.

In one arrangement, the nose can comprise a shell having a third end, a fourth end, an outer wall, and an inner wall. The third end attaches to the second end of the housing, and the inner and outer walls extend between the third and fourth ends. The outer wall is disposed circumferentially about the inner wall and defines the internal cavity therebetween, which is filled with the cement of the support. The inner wall forms the first passage communicating the valve at the third end of the shell with the distal outlet at the fourth end of the shell.

The outer wall of the shell can converge eccentrically from the third end to the fourth end of the shell. The inner wall of the shell can form the first passage cylindrically from the third end to the fourth end.

The outer wall of the shell at the third end can include an outer rim open to the internal cavity and attaching to the second end of the housing. This outer rim can comprise a snap-in feature attaching to the second end of the housing.

The outer wall at the fourth end of the shell can enclose around the distal outlet of the inner wall.

A cross member can be disposed in the internal cavity and can define a second passage communicating the first passage of the inner wall with a port defined in the outer wall of the shell.

According to the present disclosure, a nose for a float shoe on a downhole tubular, such as casing, comprises a shell having a first end, a second end, an outer wall, and an inner wall. The first end attaches to the float shoe, and the inner and outer walls extend between the first and second ends. The outer wall is disposed circumferentially about the inner wall and defines an internal cavity therebetween, which is filled with cement. The inner wall forms a first passage communicating the float shoe at the first end of the shell with a distal outlet at the second end of the shell. Features discussed previously can apply equally to the current arrangement of the nose and the shell.

According to the present disclosure, a method of manufacturing a float shoe for a downhole tubular comprises not necessarily in sequence: positioning a valve in a bore of a housing for the float shoe having first and second ends, the first end configured to attach to the downhole tubular; extending the second end of the housing with a nose by attaching a shell to the second end of the housing, the shell defining an internal cavity communicating with the bore; filling an annular space around the valve with cement to support the valve disposed in the bore of the housing; filling the internal cavity of the shell with cement; and communicating the valve with a distal outlet of the nose via a first passage in the nose.

Attaching the shell to the second end of the housing can comprise snapping a rim of the shell inside the second end of the housing and can further comprise supporting the snapped rim of the shell inside the second end of the housing using the cement.

Filling the internal cavity of the shell with the cement can be performed before attaching the shell to the second end. The annular space around the valve can be filled with the cement after attaching the shell to the second end.

Filling the internal cavity of the shell with the cement can be performed after attaching the shell to the second end. The annular space around the valve can be filled with the cement during the filling of the internal cavity.

Attaching the shell to the second end of the housing can further comprise connecting the first passage of the shell with a side port in the shell by placing a cross member in the internal cavity and having a second passage to communicate the first passage with the side port.

To communicate the valve with the distal outlet of the nose via the first passage in the nose, an inner wall of the shell can extend in the cavity from the distal outlet of the nose to the valve in the housing.

The foregoing summary is not intended to summarize each potential embodiment or every aspect of the present disclosure.

DETAILED DESCRIPTION OF THE DISCLOSURE

Figures 1, 2A, 2B, 2C:
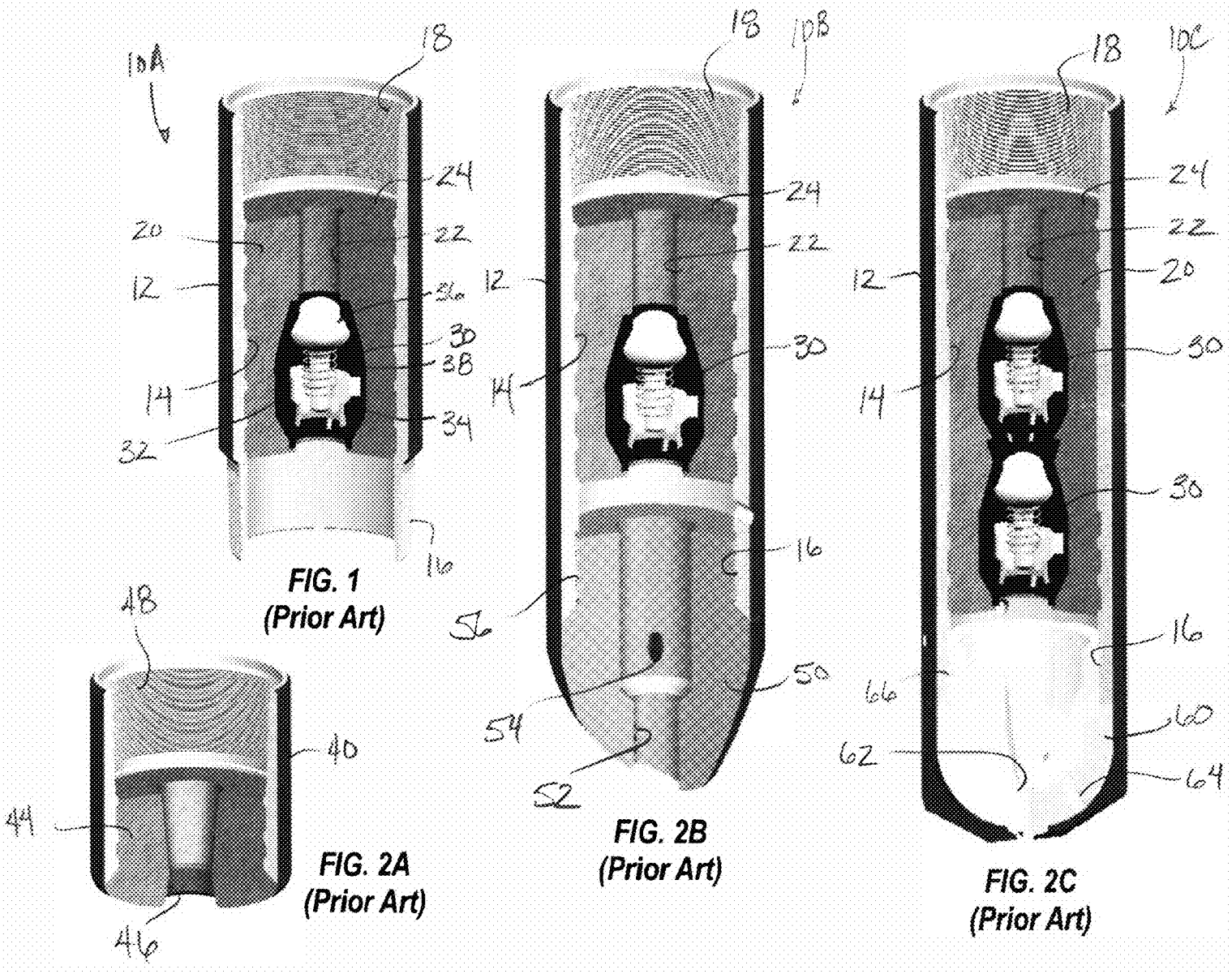
FIG. 1 (Prior Art)
FIG. 2A (Prior Art)
FIG. 2B (Prior Art)
FIG. 2C (Prior Art)
FIG. 1 illustrates a float collar known in the art for use on casing run in a borehole.
FIG. 2A illustrates a conventional nose of the prior art for use on casing or a float collar.
FIG. 2B illustrates a composite nose of the prior art for use on a float shoe.
FIG. 2C illustrates an aluminum nose of the prior art for use on a float shoe.
Figure 3:
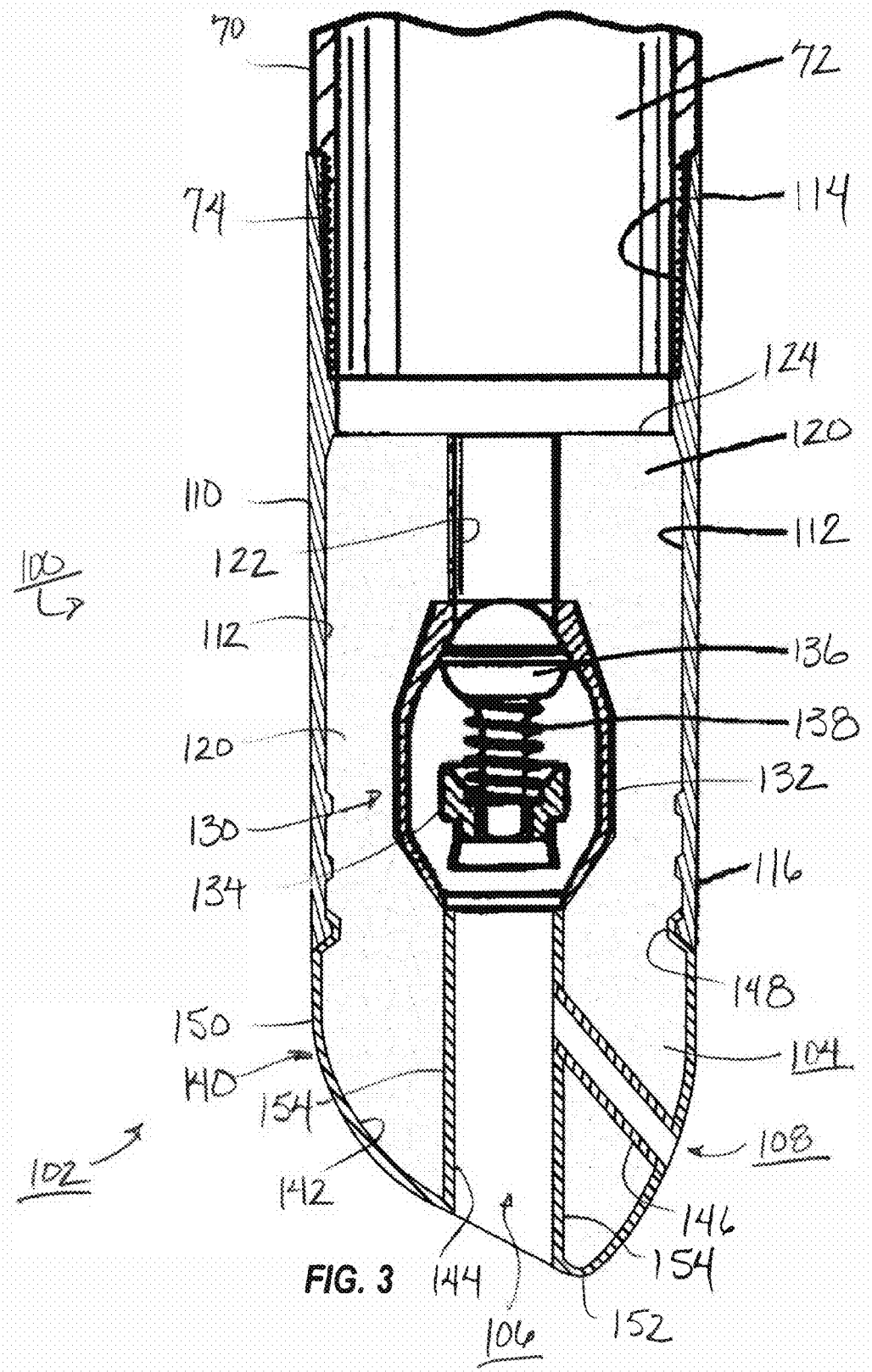
FIG. 3 illustrates a cross-sectional view of a nose of the present disclosure for use on a float shoe.

FIG. 3 illustrates a float shoe 100 according to the present disclosure. The float shoe 100 includes a housing 110, a nose 102, a support 120, and a fill valve 130. The housing 110 is a tubular and is typically composed of a metallic material similar to that used for casing. The housing 110 defines a bore 120 therethrough from a first end 114 to a second end 116. The first end 114 has a box thread that is attached to a pin end 74 of a tubular or casing 70.

The nose 102 extends from the second end 116 of the housing 110 and defines an internal cavity 104. The nose 102 has a flow passage 106 communicating a distal outlet of the nose 102 toward the bore 112 of the housing 110. In addition to the fluid passage 106, the nose 102 can also define at least one side port or jet 108 communicating the fluid passage 106 outside a side of the nose 102.

The support 120 comprises cement, which is disposed in the bore 112 of the housing 110 and disposed in the cavity 104 of the nose 102. The internal bore 112 of the housing 110 may have internal ribs, grooves, and the like to facilitate engagement with the cement support 120 filled inside.

The fill valve 130 is supported by the support cement 120 in the bore 112 of the housing 110 and is disposed in communication between the first end 114 of the housing 110 and the flow passage 106 of the nose 102. During use, fluid including mud, conditioning fluid, and cement can flow through the fill valve 130, but fluid from the borehole is not permitted to pass back uphole through the valve 130.

For example, the fill valve 130 can have a valve member 136 that is generally mushroom shaped with a head biased upwardly against a valve seat 132 by a spring 138 circumjacent a stem of the valve member 136. A base 134 in the seat 132 supports the valve member 136 and spring 138. As noted above, the interior or bore 112 of the housing 110 has an annulus filled with the support 120 of high density cement disposed therein. The cement support 120 can define a central passage 122 that connects to the fill valve 130, although the fill valve 130 may have an inlet feature.

As assembled, the float shoe 100 is mounted with its pin end 114 at the bottom of casing 70 or other tubular, and the nose 102 extends from the second end 116 of the housing 110. During use, the casing 70 having the float shoe 100 and the nose 102 is run downhole in the borehole. Once the casing 70 is in position, mud is pumped down the casing 70. The mud flows through the fill valve 130 and then passes out the fluid passage 106 in the nose 102. The mud flowing from the bottom of the casing 70 then travels upwardly through an annulus between the casing 70 and the borehole (not shown) to carry debris to the surface. Typically, mud is passed through the fill valve 130 for several hours. Conditioning fluid (usually referred to as "spacer fluid") is then pumped down the casing 70. The conditioning fluid helps remove the mud and contains chemicals that will help the cement adhere to the casing 70.

After conditioning is complete, a cement charge is pumped down the casing 70 between a top plug (not shown) and a bottom plug (not shown). (To avoid confusion with the cement support 120, the pumped cement used to set the casing 70 in the borehole is referred to as a cement charge.) After the bottom plug seats on (or near) the upper surface 124 of the float shoe 100, increasing pressure is applied to the top plug until a burst disk in the bottom plug ruptures and permits the cement charge to flow downwardly into the float shoe 100. The pressure applied to the cement charge by the top plug is transmitted to the head of the valve member 136, which moves downwardly away from valve seat 132, thereby permitting the cement charge to pass through the fill valve 130.

When the top plug contacts the bottom plug, no further cement charge passes through the fill valve 130. Pressure is then released on the top plug, and the fill valve 130 inhibits the cement charge from flowing upwardly back inside the casing 70. After the cement charge has set, the top plug, the bottom plug, the fill valve 130, the annular cement support 120, the nose 102, and any other cement below the shoe 100 is drilled out.

As noted previously, some boreholes have various features of ledges, carvings, and irregularities that can hinder the running of the casing 70 to the planned depth. To overcome these obstacles, the nose 102 of the float shoe 100 has a conical and/or eccentric shape.

Figure 4A:
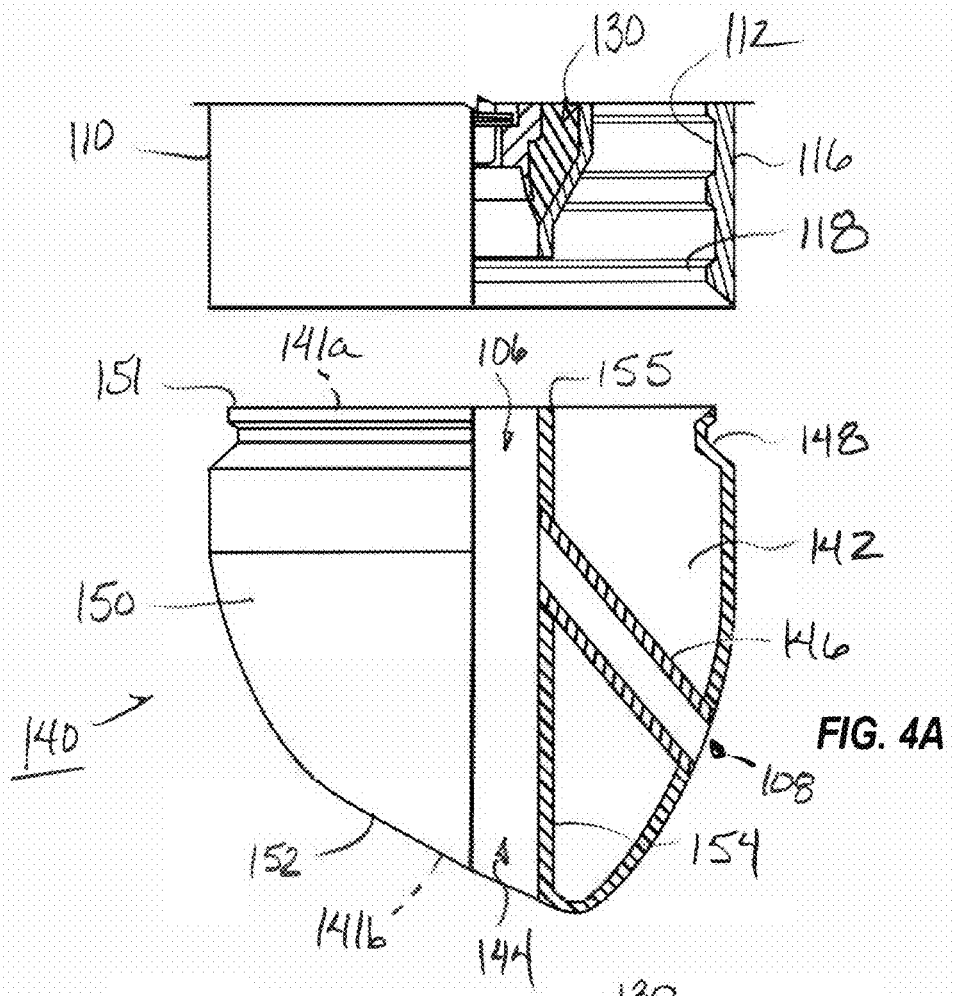
FIG. 4A illustrates a partial cross-sectional view of the nose and the float shoe of FIG. 3 in separate assembly.
Figure 4B:
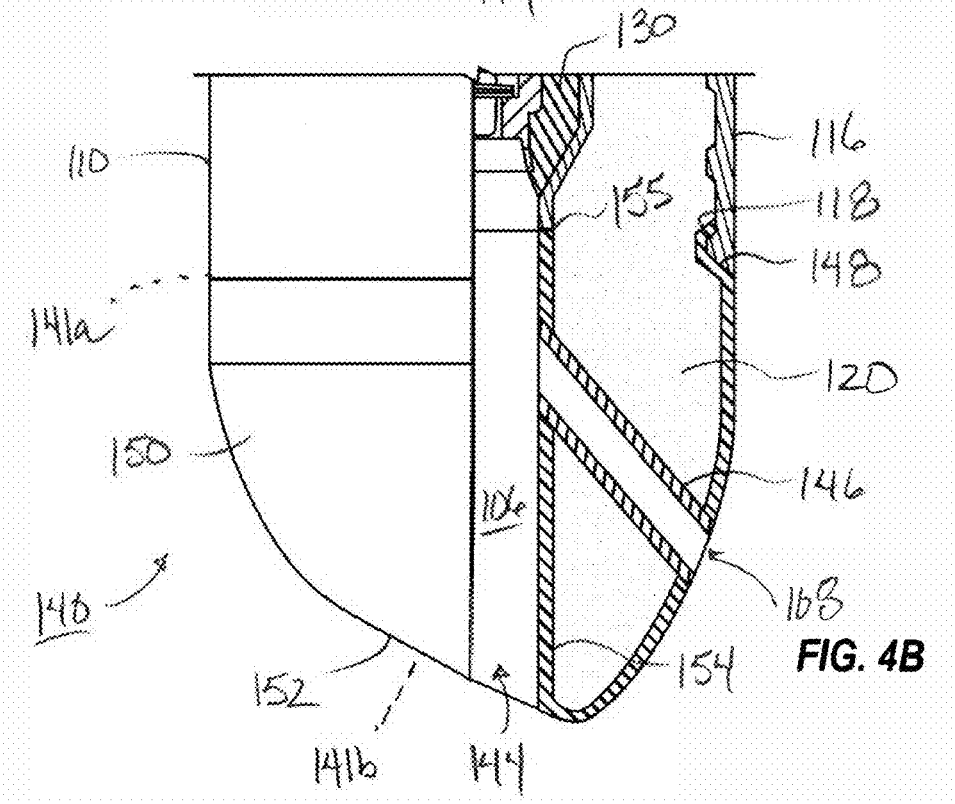
FIG. 4B illustrates a partial cross-sectional view of the nose of FIG. 4A assembled to the float shoe.

Turning to further details of the nose 102 as shown in FIG. 3 and as shown in more detail in FIGS. 4A-4B, the nose 102 includes a shell 140 composed of a plastic or a composite material. The shell 140 can also be formed of a thinner aluminum or other drillable metal. The shell 140 has a first end 141*a*, a second end 141*b*, an outer wall 150, and an inner wall 154. The first end 141*a* attaches to the housing 110 of the float shoe 100, and the inner and outer walls 150, 154 extend between the first and second ends 141*a-b* of the shell 140. The outer wall 150 is disposed circumferentially about the inner wall 154 and defines an internal cavity 142 therebetween. When assembled as shown in FIG. 4B, this internal cavity 142 is filled with the support cement 120. The inner wall 154 forms the fluid passage 106 communicating the housing 110 (more particularly the valve 130) at the first end 141*a* of the shell 140 with a distal outlet 144 at the second end 141*b* of the shell 140.

As shown, the outer wall 150 of the shell 140 converges conically from the first end 141*a* to the second end 141*b* of the shell 140 and can come to an eccentrically closed end 152 enclosed around the distal outlet 144 of the inner wall 154. For its part, the inner wall 154 of the shell 140 can form cylindrically from the first end 141*a* to the second end 141*b* to complete the fluid passage 106.

As shown in FIGS. 4A-4B, the outer wall 150 of the shell 140 at the first end 141*a* comprises an outer rim 151 open to the internal cavity 142 and attaching to the tubular housing 110 of the float shoe 100. For example, the outer rim 151 can have a snap-in feature 148 attaching to the tubular housing 110. In general, the snap-in feature 148 can include a lip, circumferential slot, indentation, teeth, ratcheting, or the like on the rim 151 that fits against a complementary lip, detent, shoulder, catch, or the like on the inside of the housing 110. Other forms of attaching, such as threading, compression fitting, pinning, gluing, etc., can be used between the housing 110 and the shell 140. The inner wall 154 of the shell 140 at the first end 141*a* has an inner rim 155 that communicates with the valve member 130 of the float shoe 100. As shown in FIG. 4B, the inner rim 155 can abut against the valve member 130 to communicate therewith.

For the side port or jet 108 of the nose 102, at least one cross member 146 can be disposed in the internal cavity 142 of the shell 140 and can communicate the fluid passage 106 of the inner wall 154 with a port defined in the outer wall 150 of the shell 140. This cross member 146 can be a tube formed or inserted in the cavity 142 and extending from one open end at the fluid passage 106 at the inner wall 154 to another open end at a hole in the outer wall 150 for the side port or jet 108.

The annular space of the float shoe 100 connects with the inner cavity 142 of the shell 140 so that a continuous extent of the cement 120 as shown in FIG. 4B can fill the annular space and the cavity 142. The continuous extent of the cement 120 is not completely necessary. At least a first extent of the cement 120 is needed to support the valve 130, and at least a second extent of the cement 120 is needed to fill cavity 142 of the shoe 102. These two extents can be separately formed and may have a gap (not shown) between them as long as the valve 130 can communicate with the fluid passage 106 and distal outlet 108 of the shoe 102. As can be seen, once casing has been set with a cement charge, the valve member 130, the cement support 120, and the shell 140 can all be readily milled out.

Figure 5A:
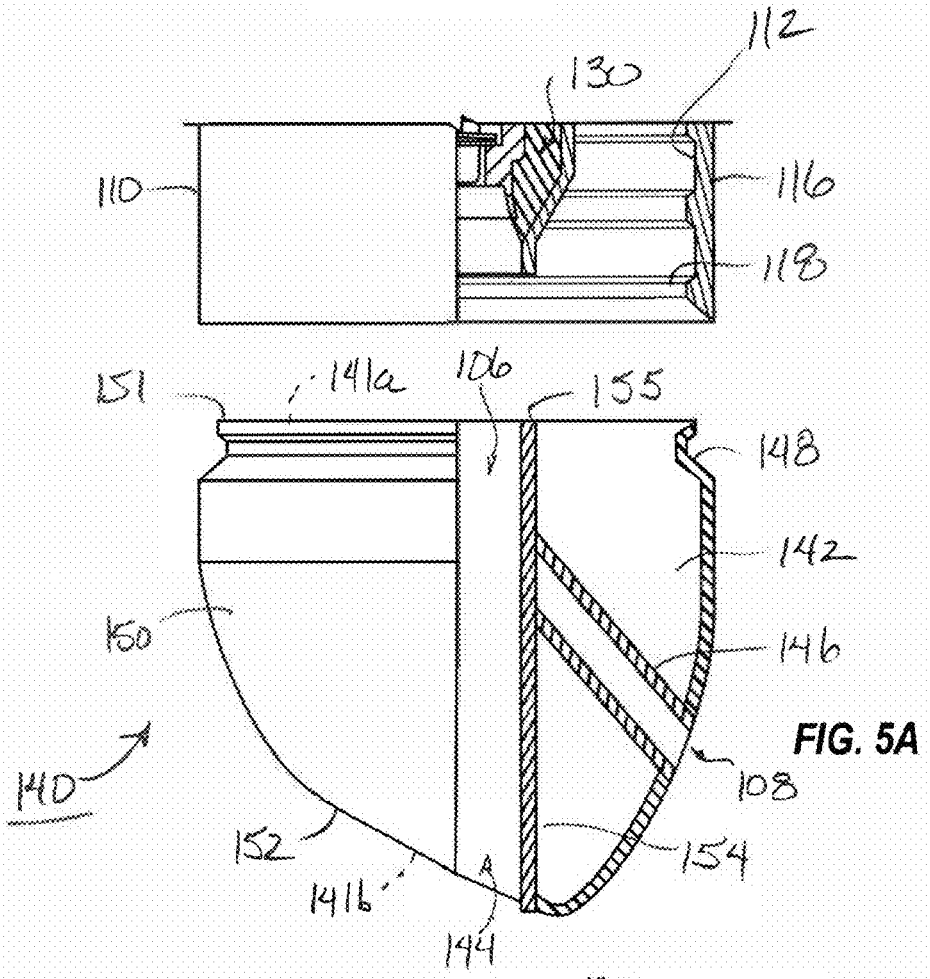
FIG. 5A illustrates a partial cross-sectional view of another nose and a float shoe in separate assembly.
Figure 5B:
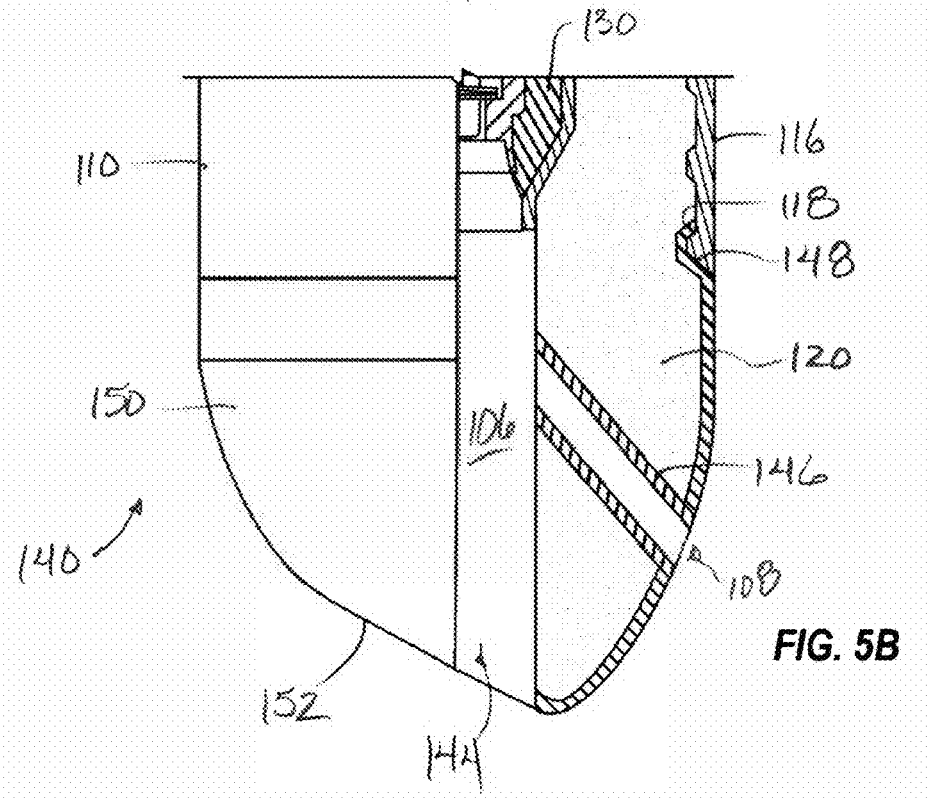
FIG. 5B illustrates a partial cross-sectional view of the nose of FIG. 5A assembled to the float shoe.

FIG. 5A-5B show an alternative shell 140 for the nose 102 of the float shoe 100. Because the inner and outer walls 150, 154 of the shell 140 help contain and form the support cement 120 in the internal cavity 142, it may not be necessary that the inner wall 154 of the shell 140 remain in place after assembly. Therefore, the inner wall 154 can be removed so that the support cement 120 defines the fluid passage 106 of the shell from the valve 130 to the distal outlet 144. Rather than having the inner wall 154 be removable or be considered part of the shell 140, the inner wall 154 may instead be a component of the fill valve 130 extending the outlet of the valve 130 to the distal outlet 144 of the shell 140.

Figure 6A:
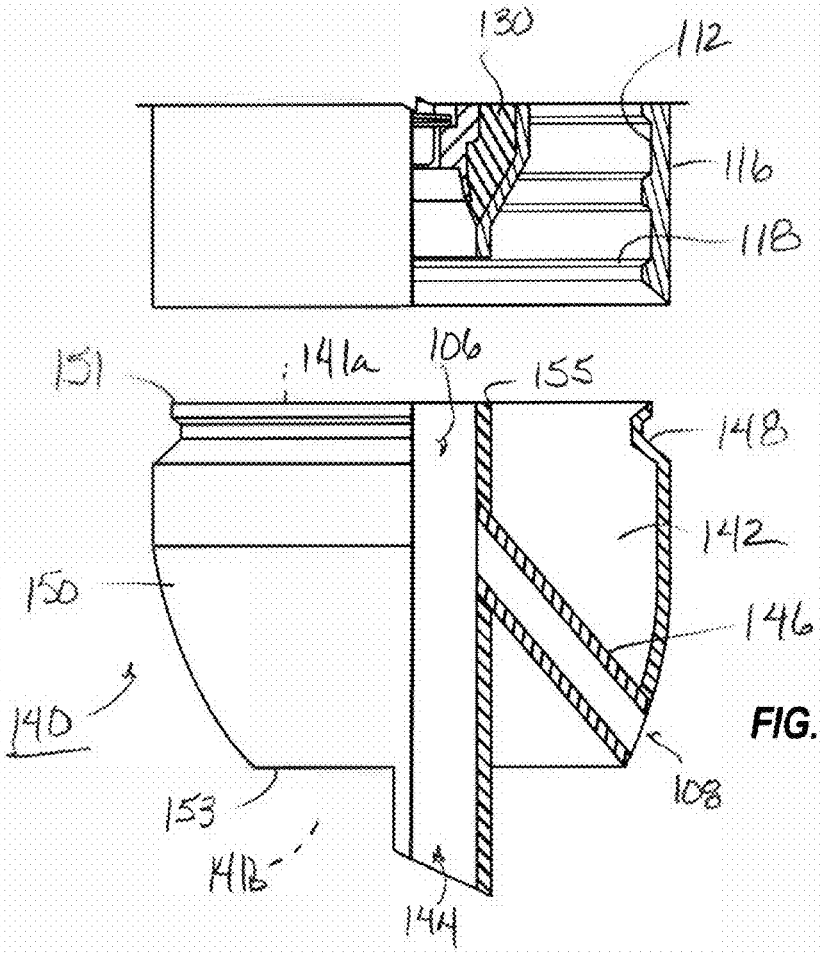
FIG. 6A illustrates a partial cross-sectional view of yet another nose and a float shoe in separate assembly.
Figure 6B:
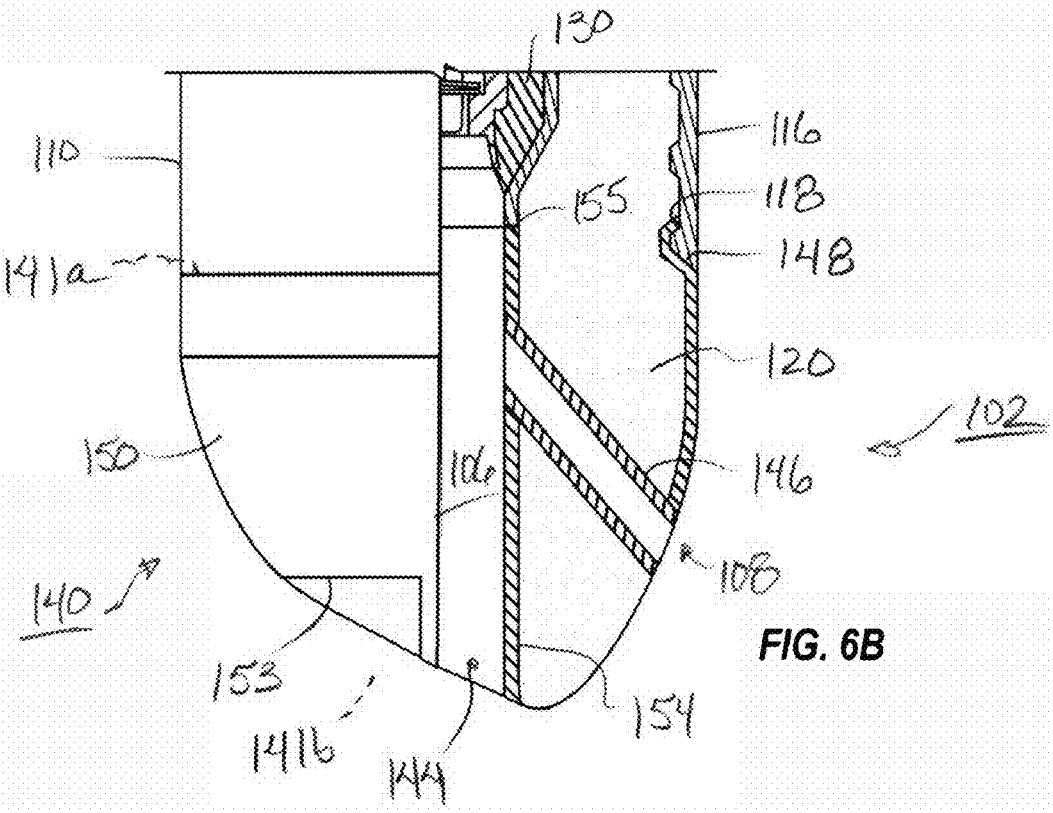
FIG. 6B illustrates a partial cross-sectional view of the nose of FIG. 6A assembled to the float shoe.

FIGS. 6A-6B show another alternative shell 140 for the nose 102 of the float shoe 100. Because the inner and outer walls 150, 154 of the shell 140 help contain and form the support cement 120 in the internal cavity 142, it may not be necessary that the outer wall 150 of the shell 140 comes to a closed end enclosed around the distal outlet 144 of the inner wall 154. Instead, the second end 141*b* can be open 153, with the support cement 120 shaped as needed for the tip of the shoe 102. The exposed cement 120 can be shaped by a temporary mold or by separate forming and/or shaving of excess cement 120.

As can be seen by the examples of FIGS. 4A through 6B, the shell 140 having the internal cavity 142 of the nose 102 and filled with support cement 120 can have a number of configurations. Overall, the outer wall 150 of shell 140 can contain the support cement 120 in the cavity 142 and can give the nose 102 a conical or eccentric shape. The outer wall 150 can be enclosed around a distal outlet 144 or may be at least partially open in which case the support cement 120 completes the shape of the nose. The inner wall 152 can be a cylindrical tube that communicates the fill valve 130 with the distal outlet 144 and can be either part of the shell 140 or part of the valve 130, as described above. Also, the cylindrical tube that forms the inner wall 152 may removable so that the support cement 120 provides the fluid passage 106 between the valve 130 and the distal end of the nose 102.

Figures 7A, 7B, 7C, 7D:
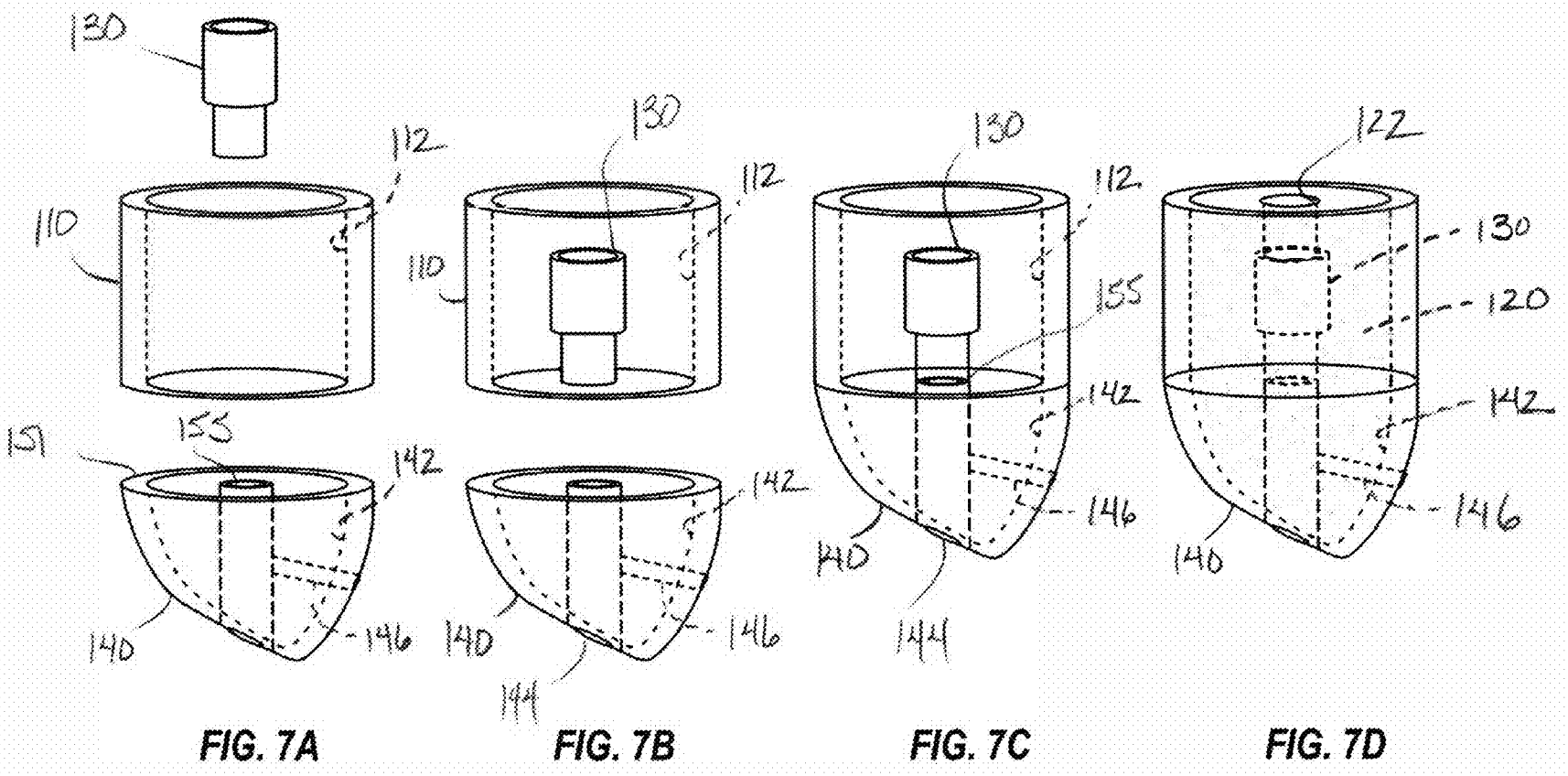
FIGS. 7A-7D illustrate steps for assembling a nose and a float shoe of the present disclosure.

FIGS. 7A-7D show one method of manufacturing a float shoe 100 for a downhole tubular according to the present disclosure. As shown in FIGS. 7A-7B, a valve member 130 is disposed in the interior bore 112 of the housing 110. One or more temporary fixtures (not shown) can be used to suspend the valve member 130 centrally in the empty interior 112 for the purposes of manufacture.

The shell 140 of the nose 102 is arranged with the inner cavity 142 open to the lower end of the housing 110. The shell 140 can be composed of a unitary piece of material formed by molding, machining, and the like. Alternatively, the shell 140 can be constructed from two or more pieces separately manufactured by molding or the like, machined as necessary, and assembled together.

In a brief example, the outer wall (150) of the shell 140 can be formed as a first cupped shaped piece, the inner wall (154) can be formed as a second tubular piece, and a port (108) can be formed as a third tubular piece. A cross port 108 can be machined in the inner wall (154) and the outer wall (150) for the cross member (146), and an outlet can be machined in the outer wall (150) for connection to the inner wall (154) to form the distal outlet 144. The pieces can then be assembled and affixed appropriately to complete the assembly of the shell 140.

As shown in FIG. 7C, the shell 140 is attached to the second end of the housing 110 using snap-in features, threading, or the like, as already noted. The internal cavity 142 of the shell 140 communicates with the hollow interior 112 of the housing 110. The inner rim 155 of the inner wall 154 can communicate the valve member 130 with a distal outlet 144 of the nose 102.

As shown in FIG. 7D, the annular space around the valve member 130 is filled with cement 120 to support the valve member 130 in the housing 110. A removable fixture (not shown) can be used to create the inlet of the inner passage 122 through the cement 120 if the valve member 130 does not include such an inlet already.

As also shown in FIG. 7D, the internal cavity 142 of the shell 140 is filled with the cement 120. In general, the internal cavity 142 of the shell 140 along with the annular space of the housing 110 can be filled together with the cement 120 after the shell 140 has been attached to the housing 110. However, alternative steps can be performed to fill the assembly with the support cement 120.

In one alternative, the internal cavity 142 of the shell 140 can initially be filled at least partially with the cement 120 before attaching the shell 140 to the housing 110. In fact, the shell 140 can be filled at least partially with the cement 120 and allowed to cure before being attached. Either way, the shell 140 with the cured cement 120 can be attached to the housing 110, which can then be separately filled with cement 120 to complete the assembly.

In another alternative, the interior of the housing 110 can be initially filled with the cement 120 and cured. The shell 140 can be filled with cement 120 and then attached to the housing 110.

In arrangements in which snap-in features are used to attach the shell 140 to the housing 110, the cement 120 is preferably used to support the attachment by keeping the shell 140 engaged in the end of the housing 110. Therefore, during manufacture, at least the area around the attachment between the shell 140 and the housing 110 is preferably filled with cement 120 after the attachment so the cement 120 can cure in place to support the attachment.

The nose 102 disclosed herein overcomes issues of drillability and cost found with conventional noses. As disclosed above, the nose 102 includes a composite preformed/molded skin or shell 140 that attaches to the bottom of the housing 110 of the float shoe 100 and that can provide a desired eccentric shape. The molded shell 140 preferably has sufficient resilience to support the placement of the valve 130 and to provide for side ports or jets.

During run-in, the shell 140 remains attached to the float shoe 100 and forms the required eccentric geometry to facilitate passage through a borehole. Being filled with cement 120, the shell 140 provides sufficient strength and drillability at a much-reduced cost. The thickness of the shell 140 can be configured as needed for the application at hand and the material used. The shell 140 can have any accepted shape typically used for fully composite or aluminum noses. Likewise, the shell 140 can have any external features, such as nodules, ribs, and the like typically used on a nose of a float shoe.

Cement is widely accepted as a having sufficient strength and drillability to create an acceptable float shoe nose. By using the shell 140 filled with the support concrete 120, the nose 102 has an eccentric shape that can be consistently manufactured. Moreover, the high compressive strength material of the cement is readily drillable and provides sufficient resistance to set down weight.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A float shoe for a downhole tubular, the shoe comprising:

a housing comprising a first material, the housing defining a bore therethrough from a first end of the housing to a second end of the housing, the first end attached to the tubular, the bore having an internal snap-in feature disposed on the bore;

a nose comprising a shell of a second material, the shell having an open proximal end and an enclosed distal end, the open proximal end having an outer rim with an external snap-in feature disposed on the outer rim, the outer rim disposed inside the bore of the housing at the second end, the external snap-in feature configured to engage with the internal snap-in feature disposed of the housing such that the shell extends from the second end of the housing, the enclosed distal end enclosing an internal cavity of the shell in communication with the bore of the housing, the nose having a first conduit connected to the enclosed distal end of the shell and extending into the internal cavity, the first conduit communicating a distal outlet of the enclosed distal end of the shell toward the bore of the housing;

a support comprising cement, the support disposed in the bore of the housing and disposed in the internal cavity of the shell about the first conduit, the support holding the external snap-in feature of the outer rim engaged with the internal snap-in feature of the housing; and a valve supported by the support in the bore of the housing, the valve disposed in communication between the first end of the housing and the first conduit.

2. The float shoe of claim 1, wherein the first material comprises a metallic material, and wherein the second material comprises a composite material.

3. The float shoe of claim 1, wherein the shell comprises an outer wall extending from the open proximal end to the enclosed distal end, the outer wall disposed circumferentially about the first conduit and defining the internal cavity therebetween, the internal cavity filled with the cement of the support, the first conduit communicating the valve at the open proximal end of the shell with the distal outlet at the enclosed distal end of the shell.

4. The float shoe of claim 3, wherein the outer wall of the shell converges eccentrically from the open proximal end to the enclosed distal end of the shell.

5. The float shoe of claim 1, wherein the first conduit extends cylindrically from the open proximal end to the enclosed distal end of the shell.

6. The float shoe of claim 1, wherein the enclosed distal end of the shell encloses around the distal outlet.

7. The float shoe of claim 3, further comprising a second conduit disposed in the internal cavity and communicating the first conduit with a port defined in the outer wall of the shell.

8. The float shoe of claim 1, wherein the first conduit comprises a separate component of the nose connected to the enclosed distal end of the shell and left in place with the cement in the internal cavity.

9. The float shoe of claim 1, wherein the first conduit comprises a passageway left in place in the cement after removal of a separate component of the nose.

10. The float shoe of claim 1, wherein the first conduit comprises an integral component of the nose connected to the enclosed distal end of the shell and surrounded with the cement in the internal cavity.

11. The float shoe of claim 1, wherein the internal snap-in feature comprises a lip disposed circumferentially about an inside surface of the bore; and wherein the external snap-in feature comprises a slot defined circumferentially about an external surface of the outer rim.

12. The float shoe of claim 1, wherein the internal and external snap-in features are selected from the group consisting of a lip, a slot, an indentation, a tooth, a ratchet, a thread, a detent, a shoulder, and a catch.

13. A method of manufacturing a float shoe for a downhole tubular, the method comprising not necessarily in sequence:

positioning a valve in a bore of a housing for the float shoe having first and second ends, the first end configured to attach to the downhole tubular, the bore having an internal snap-in feature disposed on the bore;

extending the second end of the housing with a nose by attaching an external snap-in feature disposed on an outer rim of an open proximal end of a shell to the internal snap-in feature toward the second end of the housing, the shell having an enclosed distal end enclosing an internal cavity communicating with the bore;

filling an annular space around the valve with cement to support the valve disposed in the bore of the housing;

supporting the attachment of the external snap-in feature of the outer rim inside the internal snap-in feature of the housing after attaching the external snap-in feature to the internal snap-in feature by at least filling the internal cavity of the shell inside the open proximal end with cement; and communicating the valve with a distal outlet of the nose by connecting a first conduit in the nose to the enclosed distal end of the shell and extending the first conduit into the internal cavity to be surrounded by the filled cement.

14. The method of claim 13, wherein filling the annular space and the internal cavity with the cement and attaching the external snap-in feature of the shell to the internal snap-in feature of the housing comprises:

filling at least a portion of the internal cavity of the shell with the cement before attaching the shell to the second end, attaching the shell to the second end, and filling a remaining portion of the internal cavity to support the attachment of the external snap-in feature inside the internal snap-in feature and filling the annular space around the valve with the cement to support the valve disposed in the bore of the housing, after attaching the shell to the second end.

15. The method of claim 13, wherein filling the annular space and the internal cavity with the cement and attaching the external snap-in feature of the shell to the internal snap-in feature of the housing comprises:

attaching the external snap-in feature of the shell to the internal snap-in feature of the housing, filling the internal cavity of the shell with the cement to support the attachment of the external snap-in feature inside the internal snap-in feature after attaching the shell to the housing, and filling the annular space around the valve with the cement to support the valve disposed in the bore of the housing.

16. The method of claim 13, wherein connecting the first conduit in the nose to the enclosed distal end of the shell and extending the first conduit into the internal cavity to be surrounded by the filled cement comprises positioning a separate component of the nose connected to the enclosed distal end of the shell, filling the internal cavity of the shell with the cement around the separate component, and (a) leaving the separate component in place as the first conduit after filling the internal cavity of the shell with the cement; or (b) removing the separate component to leave a passageway in place as the first conduit after filling the internal cavity of the shell with cement.

17. The method of claim 13, wherein connecting the first conduit in the nose to the enclosed distal end of the shell and extending the first conduit into the internal cavity to be surrounded by the filled cement comprises forming an integral component of the nose connected to the enclosed distal end of the shell and filling the internal cavity of the shell with the cement around the integral component as the first conduit.

18. The method of claim 13, wherein the internal snap-in feature comprises a lip disposed circumferentially about an inside surface of the bore; and wherein the external snap-in feature comprises a slot defined circumferentially about an external surface of the outer rim.

19. The method of claim 13, wherein the internal and external snap-in features are selected from the group consisting of a lip, a slot, an indentation, a tooth, a ratchet, a thread, a detent, a shoulder, and a catch.

* * * * *